US007481748B2

(12) United States Patent
Schroeder

(10) Patent No.: US 7,481,748 B2
(45) Date of Patent: Jan. 27, 2009

(54) LOCKING MECHANISM FOR A BICYCLE TRAINER

(75) Inventor: Duane G. Schroeder, New Hope, MN (US)

(73) Assignee: Kurt Manufacturing Company, Inc., Minneapolis, MN (US)

( * ) Notice: Subject to any disclaimer, the term of this patent is extended or adjusted under 35 U.S.C. 154(b) by 0 days.

(21) Appl. No.: 11/534,485

(22) Filed: Sep. 22, 2006

(65) Prior Publication Data

US 2007/0123397 A1 May 31, 2007

Related U.S. Application Data

(60) Provisional application No. 60/719,362, filed on Sep. 22, 2005.

(51) Int. Cl.
*A63B 69/16* (2006.01)

(52) U.S. Cl. ..... 482/61

(58) Field of Classification Search ..... 482/61; 74/10.9, 15.6, 45, 503, 519, 522.5, 523, 559; 70/233

See application file for complete search history.

(56) References Cited

U.S. PATENT DOCUMENTS

| | | | | |
|---|---|---|---|---|
| 2,090,550 | A | 8/1937 | Pilblad | |
| 2,227,397 | A | 12/1940 | Lucker | |
| 2,629,267 | A | 2/1953 | Hart | |
| 2,806,723 | A | 9/1957 | Fairclough | |
| 3,866,908 | A * | 2/1975 | Hangler | 482/61 |
| 4,941,651 | A | 7/1990 | Phillips | |
| 5,026,047 | A * | 6/1991 | Kosecoff | 482/59 |
| 5,145,478 | A | 9/1992 | Minoura | |
| 5,611,759 | A | 3/1997 | Zeh | |
| 6,203,472 | B1 | 3/2001 | McCraffrey | |
| 6,702,721 | B2 | 3/2004 | Schroeder | |
| 7,226,395 | B2 * | 6/2007 | Wu et al. | 482/57 |
| 2003/0158106 | A1 | 8/2003 | Duerr-Myers | |

OTHER PUBLICATIONS

CycleOps Owner's Manual, 8pp. Jun. 2003.
Figures of Device publicly disclosed before filing date of U.S. Appl. No. 60/179,362, 6pp.

* cited by examiner

*Primary Examiner*—Steve R Crow
(74) *Attorney, Agent, or Firm*—Steven M. Koehler; Westman, Champlin & Kelly, P.A.

(57) ABSTRACT

A locking mechanism includes a tube and a rod slidable with respect to the tube. A driving mechanism is adapted to engage the rod to provide movement of the rod relative to the tube and a locking mechanism is used to lock the rod in a locking position.

22 Claims, 8 Drawing Sheets

LOCKING MECHANISM FOR A BICYCLE TRAINER

CROSS-REFERENCE TO RELATED APPLICATION

The present application is based on and claims the benefit of U.S. provisional patent application Ser. No. 60/719,362, filed Sep. 22, 2005, the content of which is hereby incorporated by reference in its entirety.

BACKGROUND

Bicycle trainers have been used by bicycle enthusiasts to convert their bicycles for stationary riding. A typical user is a bicycle owner who competes in various bicycle races or rides often. When the weather prevents riding outdoors, such as when it is raining, too cold or too hot, the cyclist can use the trainer indoors to simulate a ride. In some cases, the cyclist may want to use a trainer while also reading or watching television. However, in all cases, the bicycle trainer should be easy to use and simulate bicycle riding.

A common bicycle trainer has a frame onto which the user mounts the bicycle. Typically, the rear wheel of the bicycle is in contact with a roller that, in turn, is coupled to a resistance unit. The roller is supported by the frame at a fixed distance from couplers that engage and support the bicycle in an upright position.

The frame can be equipped with a bicycle engagement mechanism to hold the bicycle in place. Aligning the engagement mechanism to secure the bicycle can be difficult due to different sizes of bicycles and the need to "lock" the bicycle in place. In one particular embodiment, opposed bicycle engagement members include threaded shafts, which are rotated to a desired position to engage the bicycle. This design, however, can be cumbersome when securing the bicycle to the frame.

SUMMARY

A locking mechanism includes a tube and a rod slidable with respect to the tube. The rod has a wheel engagement member. A driving mechanism is movable with respect to the tube and is adapted to engage the rod to provide movement of the rod relative to the tube. A locking mechanism is used to lock the rod in a locking position relative to the tube.

DETAILED DESCRIPTION

Figure 1:
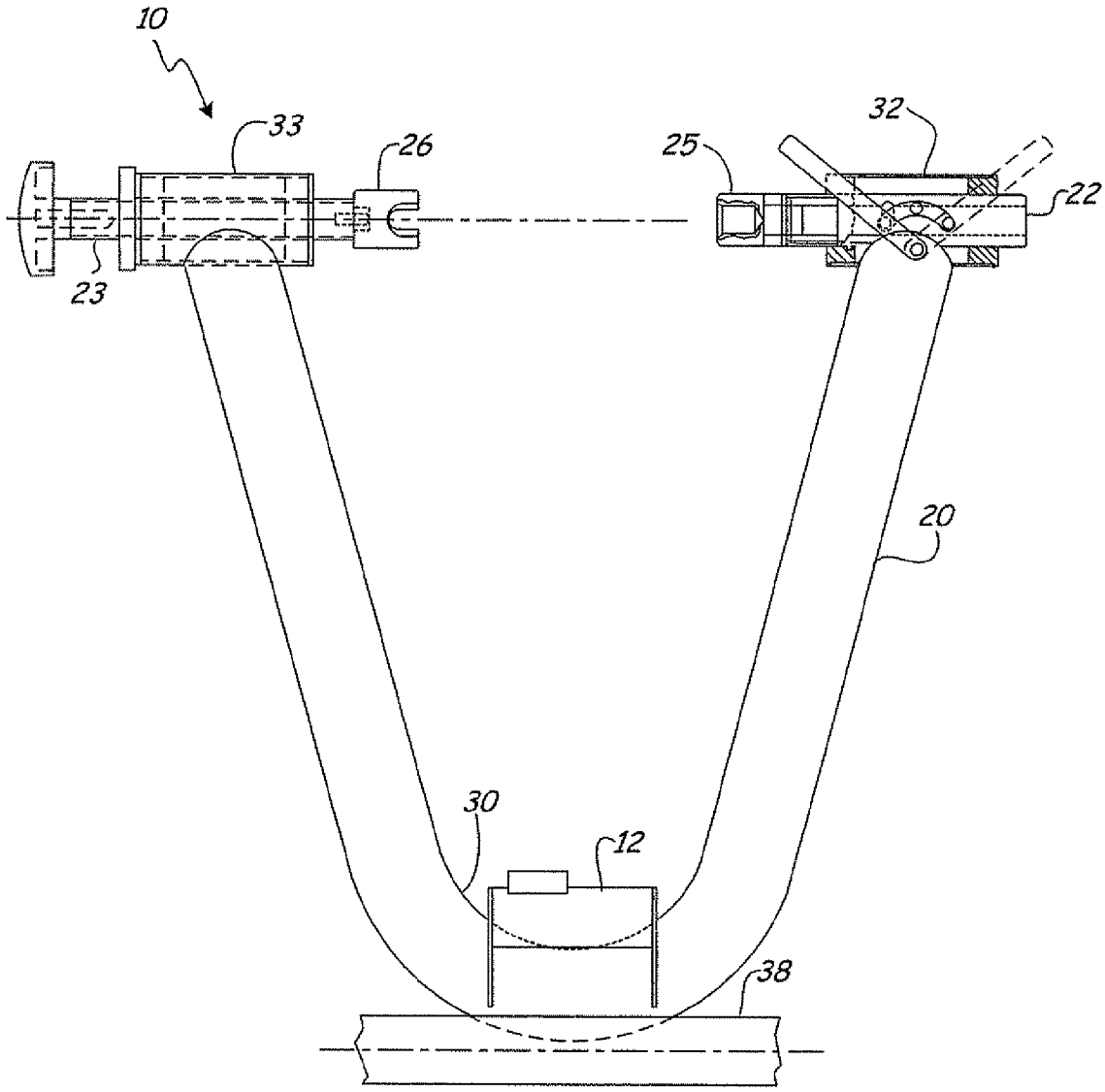
FIG. 1 is a front view of portions of a bicycle trainer.
Figure 2:
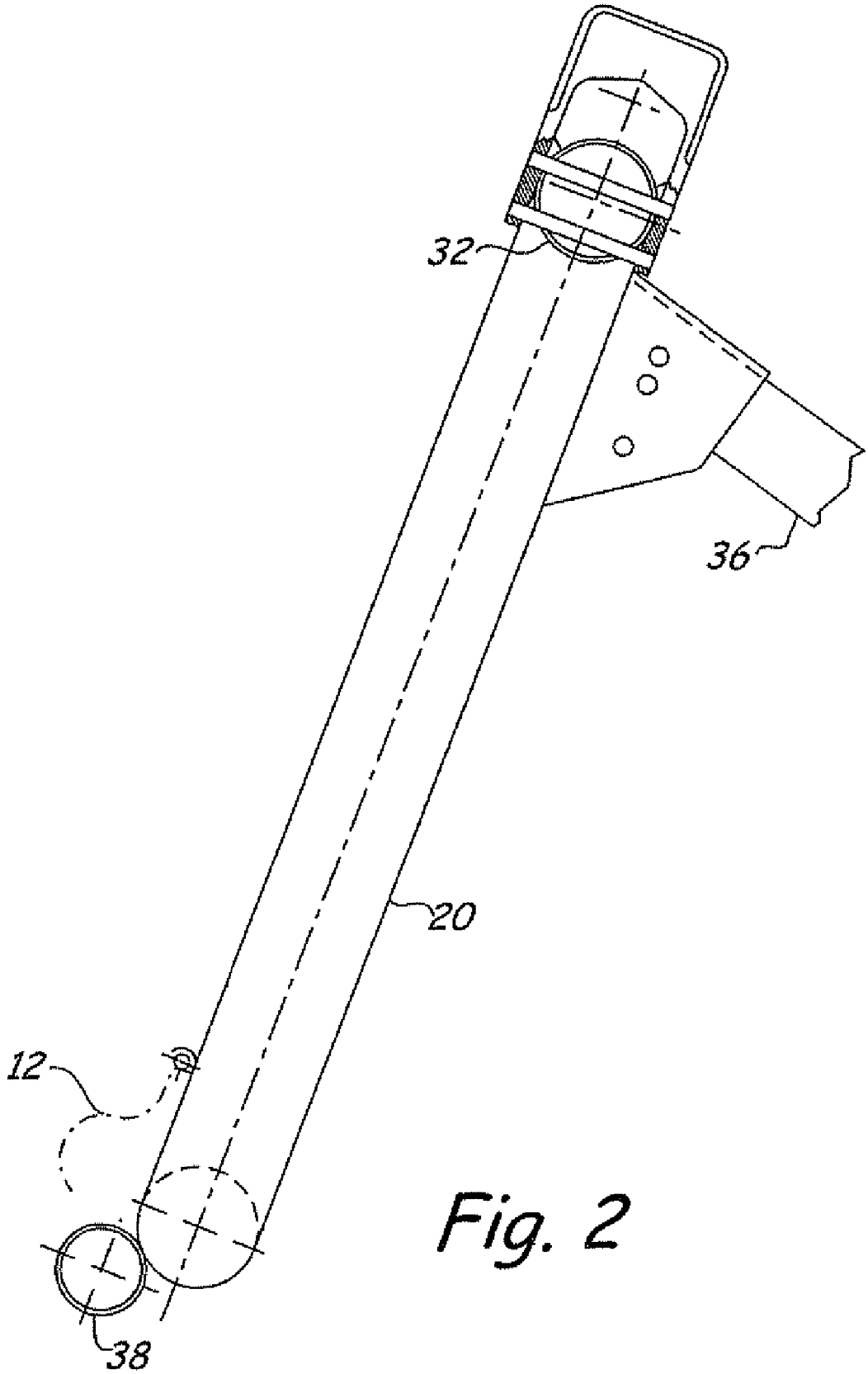
FIG. 2 is a side view of portions of the trainer of FIG. 1.

An exemplary embodiment of an exerciser or trainer 10 with a mounting bracket 12 for a movable resistance device is illustrated in FIGS. 1 and 2. As well known to those skilled in the art, trainer 10 is a bicycle trainer that is adapted to support a tire and wheel of a bicycle or other pedaled device (hereinafter "bicycle" by way of example, and used as a representation of all types of pedaled devices). The resistance device, which various types are well known, can be mounted to bracket 12 and includes a roller that engages a tire of the bicycle. The resistance device can include a rotatable resistance assembly such as an impeller rotatable in a fluid such as oil. However, it should be understood that the trainer 10 can be used with many forms of resistance devices wherein the specific implementation provided herein should not be limiting.

Trainer 10 includes a frame 20 used to support the rotating wheel of the bicycle. In the exemplary embodiment illustrated, the frame 20 includes opposed support ends 32 and 33 that support couplers 25 and 26, also referred to as wheel engagement members, for releasably supporting the bicycle above a floor. In this embodiment, the couplers 25 and 26 engage opposed portions of a wheel of the bicycle. Each of the couplers 25 and 26 include rods 22 and 23, respectively, that are movable in apertures in the frame 20 in order to adjust couplers 25 and 26 axially to engage the bicycles.

In the embodiment illustrated, the frame 20 includes a center portion 30 that is "U" or "V" shaped wherein the support ends 32 and 33 are spaced apart. Legs 36 are secured proximate the ends 32 and 33 and extend downwardly. In one embodiment, the legs 36 are pivotally secured to the center portion 30 so as to allow the frame 20 to assume a compact position for storage. In this embodiment, the frame 20 further includes a horizontal support rod 38 joined to the center portion 30 that provides additional stability. The frame 20 herein illustrated is but one example and should not be considered limiting.

Figure 3:
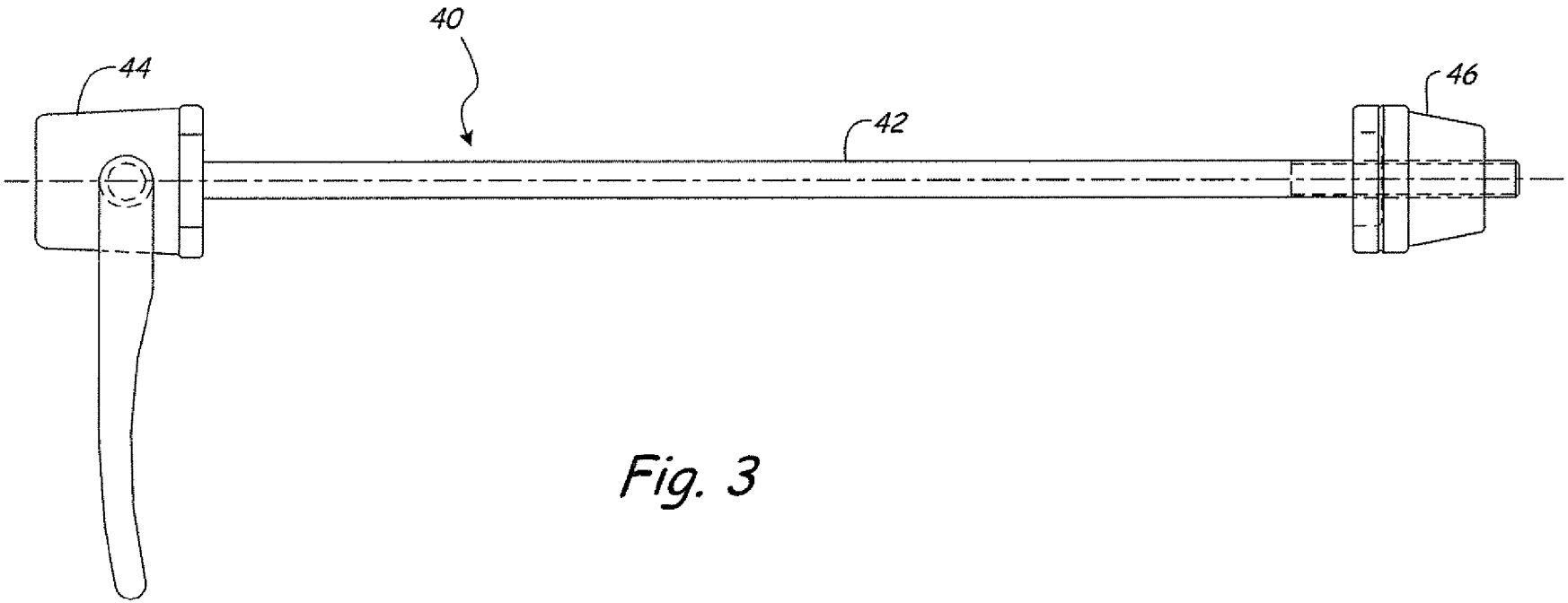
FIG. 3 is a top view of a skewer.
Figure 4:
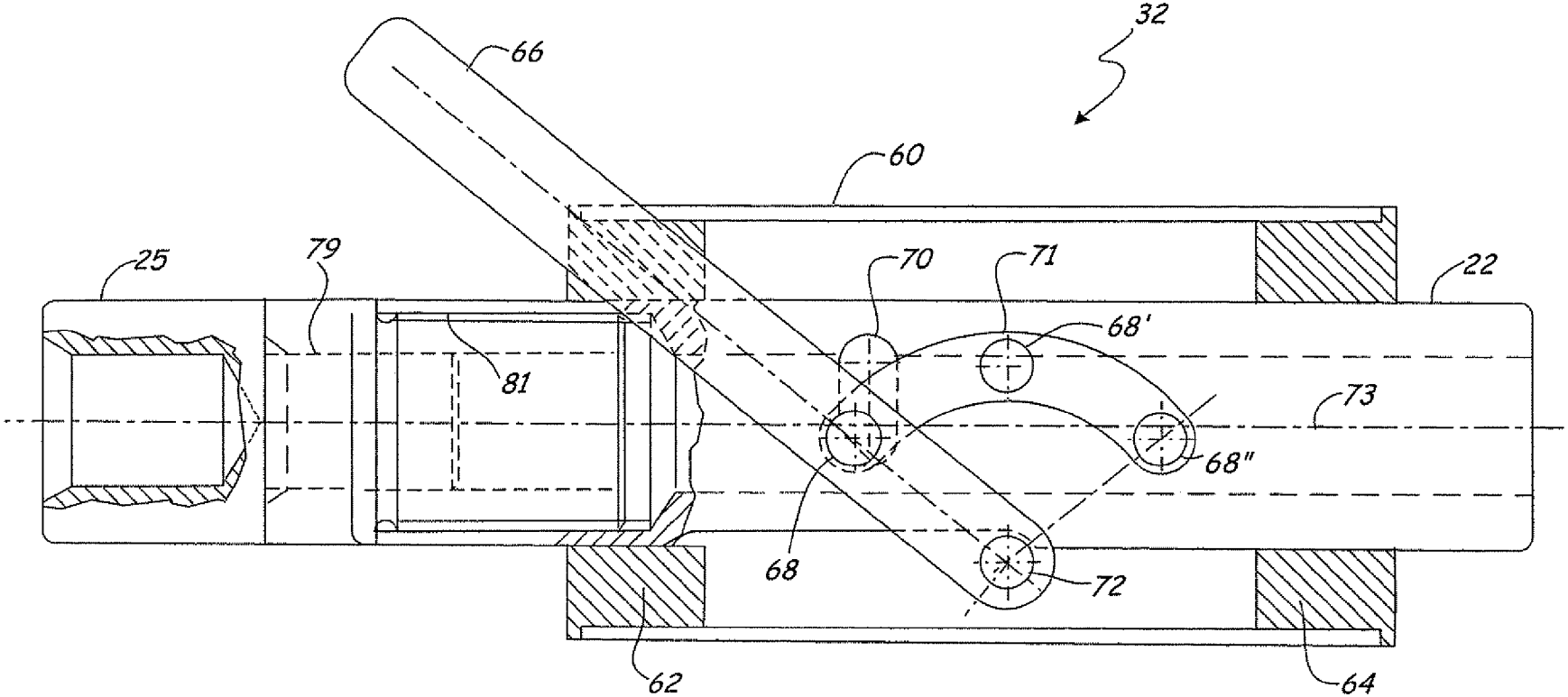
FIG. 4 is a side view of a locking mechanism.
Figure 5:
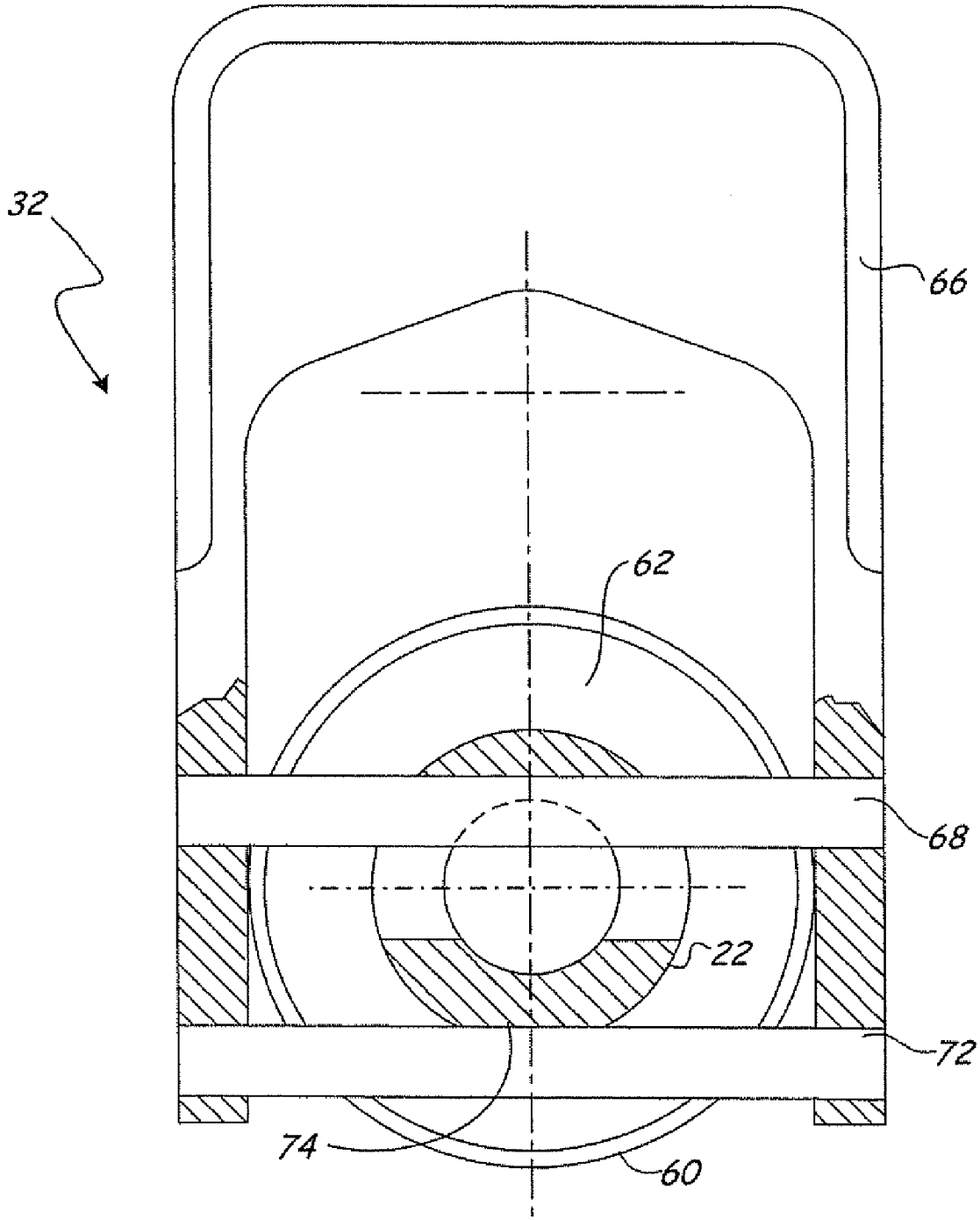
FIG. 5 is an end view of the locking mechanism of FIG. 4.
Figure 6:
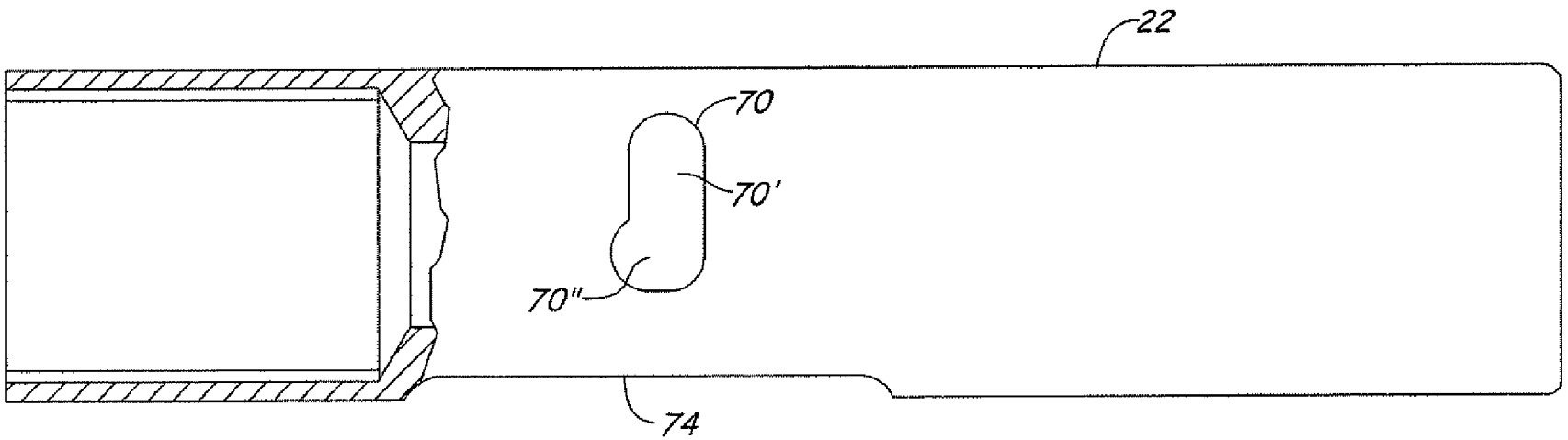
FIG. 6 is a side view of a rod.
Figure 7:
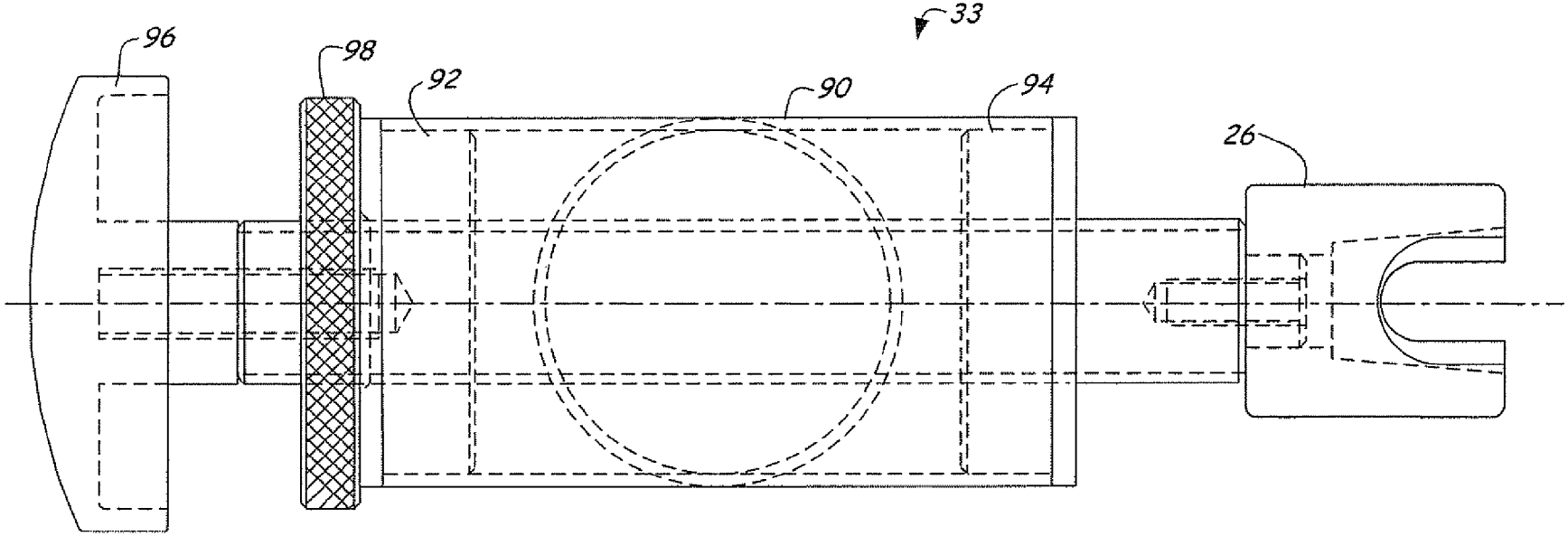
FIG. 7 is a side view of a wheel engagement member.

FIG. 3 is a top view of a skewer 40 of a bicycle. Skewer 40 is attached to a bicycle wheel and includes a rod 42 and two nuts 44 and 46 at opposite ends of rod 42. Bicycle trainer 10 includes a bicycle engagement mechanism to quickly and easily secure a bicycle to trainer 10. FIGS. 4-6 illustrate detailed views of components of support end 32 that is used to engage one side of a bicycle wheel, for example nut 44. FIG. 7 is a detailed view of support end 33 for engaging the other side of the bicycle wheel, for example nut 46.

Referring to FIGS. 4-5, support end 32 includes a tube 60 having bushings 62 and 64 at opposed ends of the tube 60. Bushings 62 and 64 engage rod 22 such that rod 22 is slidable with respect to tube 60 in order for wheel engagement member 25 to engage one side of a bicycle wheel. Bushings 62 and 64 can be made of various materials. In one example, bushings 62 and 64 are made of nylon and an opening can be formed within the bushings to accommodate rod 22 such that movement of rod 22 relative to tube 60 requires a desired force due to friction between rod 22 and bushings 62 and 64.

A lever 66 is coupled to rod 22 using a pin-slot connection having a driving pin 68 provided in a slot 70 formed within rod 22. Although herein illustrated wherein slot 70 is within rod 22, a pin-slot connection can also be formed wherein a pin extends from rod 22 to cooperate with a slot. For example, the slot could be placed in lever 66 or tube 60. Lever 66 is movable to a plurality of positions along an outer circumference of a length of tube 60. In particular, lever 66 pivots relative to tube 60 about a pivot pin 72, which herein also couples lever 66 to tube 60. As a user pivots lever 66 about pivot pin 72, driving pin 68 travels in an arcuate path, for example to positions 68' and 68". An arcuate slot 71 is provided within tube 60 to accommodate the movement of driving pin 68.

The movement of driving pin 68 forms a driving mechanism that provides movement of rod 22 relative to tube 60. Driving pin 68 is coupled with slot 70 to effectuate this movement. With further reference to FIG. 6, slot 70 includes a vertical portion 70' and a locking portion 70". While driving pin 68 is in vertical portion 70', rod 22 can move with respect to tube 60. When driving pin 68 is in locking portion 70", rod 22 is locked with respect to tube 60. This locking is effectuated from locking portion 70" forming a pocket that is offset with respect to vertical portion 70' as well as a central axis 73 of rod 22.

Although cooperation of pin 68 with slot 70 provides an innovative and useful locking mechanism in and of itself, other locking mechanisms can be utilized that lock rod 22 with respect to tube 60. For example, a locking mechanism including selectively cooperating elements between lever 66 and tube 60 could also be used.

Pivot pin 72 can be located at various distances from pin 68 and a top end of lever 66 to establish a desired force for which to drive and lock rod 22. In the embodiment illustrated, rod 22 includes a recess 74 to accommodate pivot pin 72 as rod 22 slides relative to tube 60.

When skewer 40 is positioned between wheel engagement members 25 and 26, operation of lever 66 provides a force that is transferred from engagement member 25, through skewer 40 to engagement member 26. This force can be significant enough to cause support ends 32 and 33 of frame 20 to spread apart such that a bicycle is locked in place. One way to adjust the force loaded on skewer 40 is to provide wheel engagement member 25 with a threaded shaft 79 that engages a threaded portion 81 of rod 22. The wheel engagement member 25 can thus be positioned with respect to rod 22 such that a desired force provided from support end 32 is achieved as well as accommodate various dimensions of bicycle wheels.

FIG. 7 is a side view of support end 33 that also includes an adjustable mechanism wherein a wheel engagement member can engage a wheel. Support end 33 includes a tube 90 and bushings 92 and 94 positioned at opposite ends of tube 90. Rod 23 includes a threaded shaft and a rotatable knob 96. Bushing 92 forms a guide bushing to guide rod 23 and bushing 94 is threaded to engage the threaded shaft of rod 23.

In order to engage a wheel of a bicycle, a person can rotate knob 96 such that wheel engagement member 26 moves away from tube 90 in order to engage the skewer 40 of the bicycle. The position of wheel engagement member 26 can thus be adjusted to center a bicycle with respect to frame 20 and/or adjust a force that locks the bicycle into place. A locking nut 98 is further provided to lock rod 23 relative to tube 90. Locking nut 98 is threaded to engage the threaded shaft of rod 23. When locking nut 98 engages tube 90, rod 23 is locked with respect to tube 90.

Figure 8:
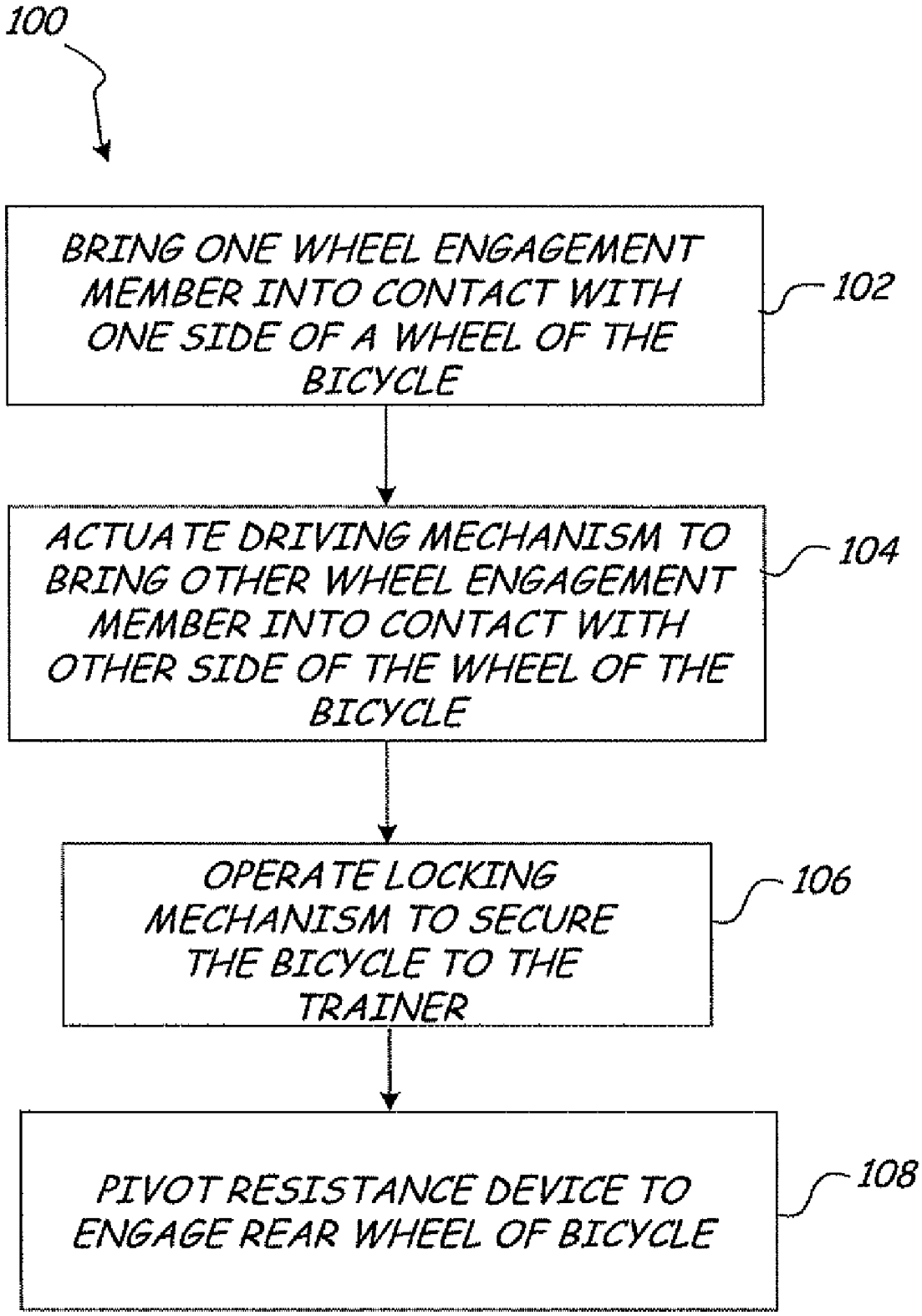
FIG. 8 is a flow diagram of a method for securing a bicycle to a trainer.

FIG. 8 is a flow diagram of an exemplary method 100 for securing a bicycle to bicycle trainer 10. Method 100 begins at step 102 wherein wheel engagement member 26 is brought into contact with a bicycle, for example by rotating knob 96. At step 104, a driving mechanism is actuated to bring wheel engagement member 25 into contact with the other side of the bicycle wheel. This movement is effectuated by actuation of lever 66 towards the wheel. In order to further secure the bicycle to the trainer 10, a locking mechanism is operated at step 106. For example, this can be performed by driving pin 68 entering into locking portion 70" and dropping driving pin 68 into a pocket in locking portion 70" located below central axis 73 of rod 22. At step 108, a resistance device is pivoted such that the device engages the wheel of the bicycle. After use, the bicycle can be released from trainer 10, for example by actuating lever 66 away from the wheel.

Trainer 10 thus includes a simple locking mechanism that easily and quickly secures a bicycle to the trainer 10. By simply activating lever 66, the bicycle is locked into place and a user can begin training in a secured manner.

Although the subject matter above has been described with reference to specific embodiments, workers skilled in the art will recognize that changes may be made in form and detail without departing from the spirit and scope of the concepts described herein.

What is claimed is:

1. A bicycle engagement device adapted for use with a pedaled device, the device comprising:

a tube;

a rod slidable with respect to the tube;

a wheel engagement member coupled to the rod;

a driving mechanism movable between a first position and a second position along a length of an outer surface of the tube, the driving mechanism including a lever pivotable about a pivot pin with respect to the tube and a driving pin coupled to the lever and adapted to engage the rod to provide movement of the rod relative to the tube, wherein the driving pin is positioned within a slot of the rod, the lever adapted to move the driving pin in an arcuate path; and a locking mechanism adapted to lock the rod relative to the tube.

2. The device of claim 1 wherein the tube includes a pair of nylon bushings to frictionally engage the rod.

3. The device of claim 1 wherein the lever is positioned around a portion of the outer circumference of the tube.

4. The device of claim 1 wherein the locking mechanism includes a locking portion positioned in the slot that is offset with respect to a central axis of the rod.

5. The device of claim 4 wherein the locking portion further comprises a pocket that is offset with respect to a longitudinal portion of the slot.

6. The device of claim 1 wherein the tube includes an arcuate slot to accommodate the driving pin.

7. The device of claim 1 wherein the rod includes a recess to accommodate the pivot pin.

8. The device of claim 1 and further comprising:

a frame coupled to the tube;

a support end coupled to the frame and spaced apart from the tube; and a second wheel engagement member movably coupled to the support end.

9. A method of securing a wheel of a bicycle to an exercise device, comprising:

providing a frame with first and second support ends;

providing a first wheel engagement member coupled to the first support end;

providing a second wheel engagement member coupled to the second support end;

providing a rod coupled to the first wheel engagement member;

providing a driving mechanism movable between a first position and a second position along an outer surface of a length of the first support end to drive the rod relative to the first support end, the driving mechanism including a lever pivotable about a pivot pin with respect to the first support end and a driving pin coupled to the lever and adapted to engage the rod, wherein providing the driving mechanism further comprises providing a slot in the rod and positioning the driving pin in the slot; and providing a locking mechanism to lock the rod relative to the first support end, which comprises providing a locking portion in the slot, the locking portion being offset with respect to a longitudinal portion of the slot and a central axis of the rod.

10. The method of claim 9 and further comprising:

positioning a bicycle wheel between the first wheel engagement member and the second wheel engagement member; and actuating the lever to lock the bicycle wheel with respect to the frame.

11. The method of claim 9 and further comprising:

providing a recess in the rod to accommodate the pivot pin.

12. The method of claim 9 and further comprising:

providing an arcuate slot in the first support end to accommodate the driving pin.

13. A bicycle trainer for supporting a pedaled device, comprising:

a frame;

a first support end coupled to the frame;

a second support end spaced apart from the first support end and coupled to the frame;

a first wheel engagement member coupled to the first support end;

a second wheel engagement member coupled to the second support end;

a rod coupled to the first wheel engagement member and slidable with respect to the first support end;

a pivot pin coupled to the first support end;

a driving pin pivotable about the pivot pin between a first position and a second position, the driving pin forming a pin-slot connection with the rod in order to drive the rod with respect to the first support end; and a slot engaging the driving pin such that the rod is movable with respect to the first support end when the driving pin is in the first position and locked with respect to the first support end when the driving pin is in the second position.

14. The trainer of claim 13, wherein the driving pin and the pivot pin are coupled to a lever.

15. The trainer of claim 13, wherein the slot is positioned within the rod.

16. The trainer of claim 13, wherein the slot includes a pocket positioned therein to receive the driving pin in the second position.

17. The trainer of claim 13 wherein the driving pin travels in an arcuate path.

18. A bicycle trainer for supporting a pedaled device, comprising:

a frame;

a first support end coupled to the frame, the first support end comprising:

a tube;

a rod slidable with respect to the tube;

a wheel engagement member coupled to the rod;

a driving mechanism movable between a first position and a second position along a length of an outer surface of the tube, the driving mechanism including a lever pivotable about a pivot pin with respect to the tube and a driving pin coupled to the lever and adapted to engage the rod to provide movement of the rod relative to the tube, wherein the rod includes a recess to accommodate the pivot pin; and a locking mechanism adapted to lock the rod relative to the tube; and a second support end spaced apart from the first support end and coupled to the frame.

19. The bicycle trainer of claim 18 wherein the lever is positioned around a portion of the outer circumference of the tube.

20. The bicycle trainer of claim 18 wherein the locking mechanism includes a locking portion positioned in the slot that is offset with respect to a central axis of the rod.

21. The bicycle trainer of claim 20 wherein the locking portion further comprises a pocket that is offset with respect to a longitudinal portion of the slot.

22. The bicycle trainer of claim 1 wherein the tube includes an arcuate slot to accommodate the driving pin.

* * * * *